US010668321B2

(12) United States Patent
Yoo

(10) Patent No.: US 10,668,321 B2
(45) Date of Patent: Jun. 2, 2020

(54) MOTORLESS TREADMILL

(71) Applicant: DRAX INC., Gyeonggi-do (KR)

(72) Inventor: Seon Kyung Yoo, Seoul (KR)

(73) Assignee: Drax Inc., Gyeonggi-do (KR)

( * ) Notice: Subject to any disclaimer, the term of this patent is extended or adjusted under 35 U.S.C. 154(b) by 29 days.

(21) Appl. No.: 16/028,292

(22) Filed: Jul. 5, 2018

(65) Prior Publication Data

US 2019/0009128 A1 Jan. 10, 2019

(30) Foreign Application Priority Data

Jul. 4, 2017 (KR) ..... 20-2017-0003468

(51) Int. Cl.

| | |
|---|---|
| ***A63B 22/02*** | (2006.01) |
| ***A63B 24/00*** | (2006.01) |
| ***A63B 22/00*** | (2006.01) |
| ***A63B 22/20*** | (2006.01) |

(52) U.S. Cl.

CPC ..... *A63B 22/0285* (2013.01); *A63B 22/02* (2013.01); *A63B 22/0017* (2015.10); *A63B 22/0207* (2015.10); *A63B 2022/206* (2013.01); *A63B 2024/0093* (2013.01)

(58) Field of Classification Search

CPC ..... A63B 22/0285; A63B 22/02; A63B 2022/206; A63B 22/0017; A63B 22/0207; A63B 24/0093; A63B 71/0622

See application file for complete search history.

(56) References Cited

U.S. PATENT DOCUMENTS

| | | | | |
|---|---|---|---|---|
| 5,642,880 | A * | 7/1997 | Wiseman | A63B 69/0002 473/417 |
| 8,480,541 | B1 * | 7/2013 | Brunts | A63B 22/0242 482/1 |
| 8,690,738 | B1 * | 4/2014 | Astilian | A63B 21/156 482/54 |
| 8,905,905 | B2 * | 12/2014 | Mangalindan | A63B 23/1236 482/141 |
| 9,114,276 | B2 * | 8/2015 | Bayerlein | A63B 21/0053 |
| 10,086,254 | B2 * | 10/2018 | Watterson | A63B 71/0686 |
| 10,293,204 | B2 * | 5/2019 | Astilean | A63B 21/156 |
| 2008/0280704 | A1 * | 11/2008 | Noll | A63B 69/0071 473/447 |
| 2013/0157789 | A1 * | 6/2013 | Grady | A63B 69/38 473/463 |

(Continued)

FOREIGN PATENT DOCUMENTS

KR 1020080016223 2/2008

*Primary Examiner* — Gary D Urbiel Goldner

(74) *Attorney, Agent, or Firm* — Klarquist Sparkman, LLP

(57) ABSTRACT

There is provided a motorless treadmill. The motorless treadmill includes: a motorless track having a curved shape such that an inclination angle increases with respect to a ground surface toward a front end and a rear end, and configured to move around a closed path by a user's footsteps; and a pair of side covers disposed on two opposing sides of the motorless track, wherein the motorless track changes movement speed according to a location at which the user steps on the motorless track, and wherein, on at least one side cover of the pair of side covers, a speed-related indicator is disposed to indicate information related to the movement speed of the motorless track.

7 Claims, 7 Drawing Sheets

(56) References Cited

U.S. PATENT DOCUMENTS

| | | | | |
|---|---|---|---|---|
| 2013/0178344 | A1* | 7/2013 | Walsh | A01K 87/00 482/122 |
| 2016/0067537 | A1 | 3/2016 | Bayerlein et al. | |
| 2016/0213976 | A1* | 7/2016 | So | A63B 71/0622 |
| 2016/0367851 | A1 | 12/2016 | Astilean et al. | |
| 2017/0312566 | A1* | 11/2017 | Chang | A63B 22/0285 |
| 2019/0070455 | A1* | 3/2019 | Cei | A63B 22/0285 |
| 2019/0118030 | A1* | 4/2019 | Yoo | A63B 22/02 |
| 2019/0168067 | A1* | 6/2019 | Bates | A63B 22/0285 |

* cited by examiner

MOTORLESS TREADMILL

This application claims the benefit of Korean Patent Application No. 10-2017-0003468, filed on Jul. 4, 2017, in the Korean Intellectual Property Office, the disclosure of which is incorporated herein in its entirety by reference.

BACKGROUND

1. Field

One or more embodiments relate to a motorless treadmill, and more particularly, to a motorless treadmill that changes a speed according to a location at which a user steps on the motorless treadmill.

2. Description of the Related Art

A treadmill is exercise equipment also called a running machine, and widely used in homes, sports centers, etc. since it uses a belt moving around a caterpillar track to provide the exercise effects of walking or running in a small space. Since the treadmill enables users to exercise, such as walking or running exercise indoors, at an appropriate temperature even in winter and to adjust a running speed, demand thereof is increasing day by day.

The treadmill is classified into a motor treadmill in which a belt is moved by separate driving means and a motorless treadmill in which a belt is moved by a user's operation without separate driving means.

The motorless treadmill is low-priced and has a small size and lightweight compared to the motor treadmill since it does not require separate driving means. Recently, the demand for the motorless treadmill is increasing gradually.

SUMMARY

One or more embodiments include a motorless treadmill having a speed-related indicator for enabling a user to easily understand the property of a motorless track that changes a speed according to a location at which the user steps on the motorless track and to use the motorless track according to the property of the motorless track.

Additional aspects will be set forth in part in the description which follows and, in part, will be apparent from the description, or may be learned by practice of the presented embodiments.

According to one or more embodiments, there is provided a motorless treadmill including: a motorless track having a curved shape such that an inclination angle increases with respect to the ground toward a front end and a rear end, and configured to move around by user's foot steps; and a pair of side covers disposed on both sides of the motorless track, wherein the motorless track changes a movement speed according to a location at which the user steps on the motorless track, and wherein on at least one side cover of the pair of side covers, a speed-related indicator is disposed to indicate information related to the movement speed of the motorless track.

According to an embodiment, the motorless track may include a plurality of inclination areas inclined at a greater inclination angle with respect to the ground toward the front end.

According to an embodiment, the speed-related indicator may include a plurality of speed areas extending along a movement direction of the motorless track.

According to an embodiment, the plurality of speed areas may be disposed on the side cover in such a way to face the motorless track.

According to an embodiment, neighboring speed areas of the plurality of speed areas may have different colors to be distinguished from each other.

According to an embodiment, the plurality of speed areas may have different lengths.

According to an embodiment, the lengths of the plurality of speed areas may be shortened toward the front end.

According to an embodiment, the speed-related indicator may include a plurality of lines spaced from each other along the movement direction of the motorless track.

According to an embodiment, the plurality of lines may have different colors.

According to an embodiment, the motorless track may include: a plurality of slats extending in a direction that is perpendicular to the movement direction of the motorless track; and a support frame supporting the plurality of slats such that the plurality of slats move.

Other aspects, features, and advantages than those described above will be obvious from the following drawings and claims, and the detailed description.

The general and detailed aspects may be embodied within system, method, computer program, or any combination thereof.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

A configuration of a treadmill according to an embodiment of the present disclosure will be described with reference to the accompanying drawings. In the following descriptions, detailed descriptions about known functions or configurations will be omitted in order to clarify the gist of the present disclosure.

Figure 1:
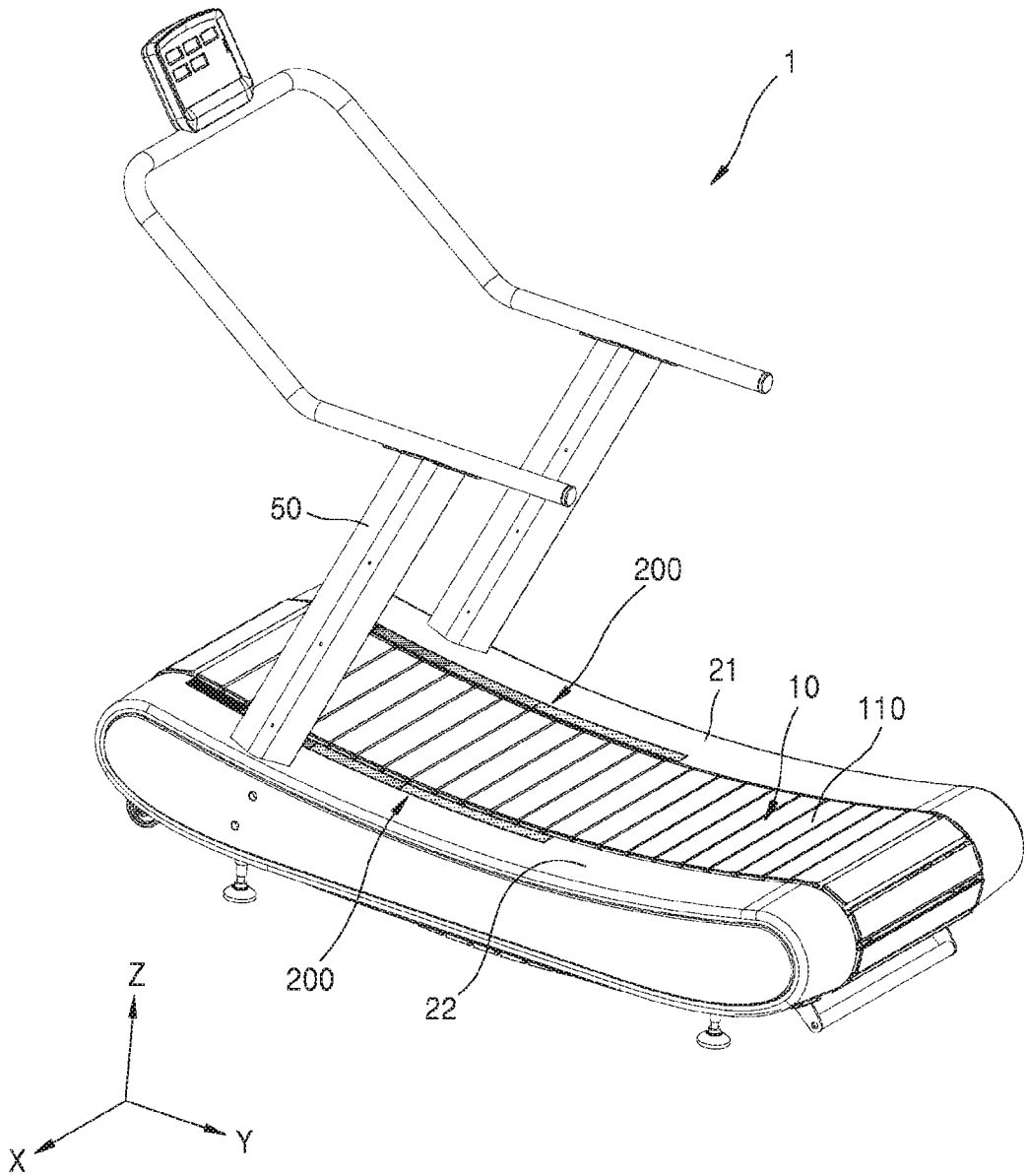
FIGS. 1 and 2 are perspective views of a motorless treadmill according to an embodiment of the present disclosure.
Figure 2:
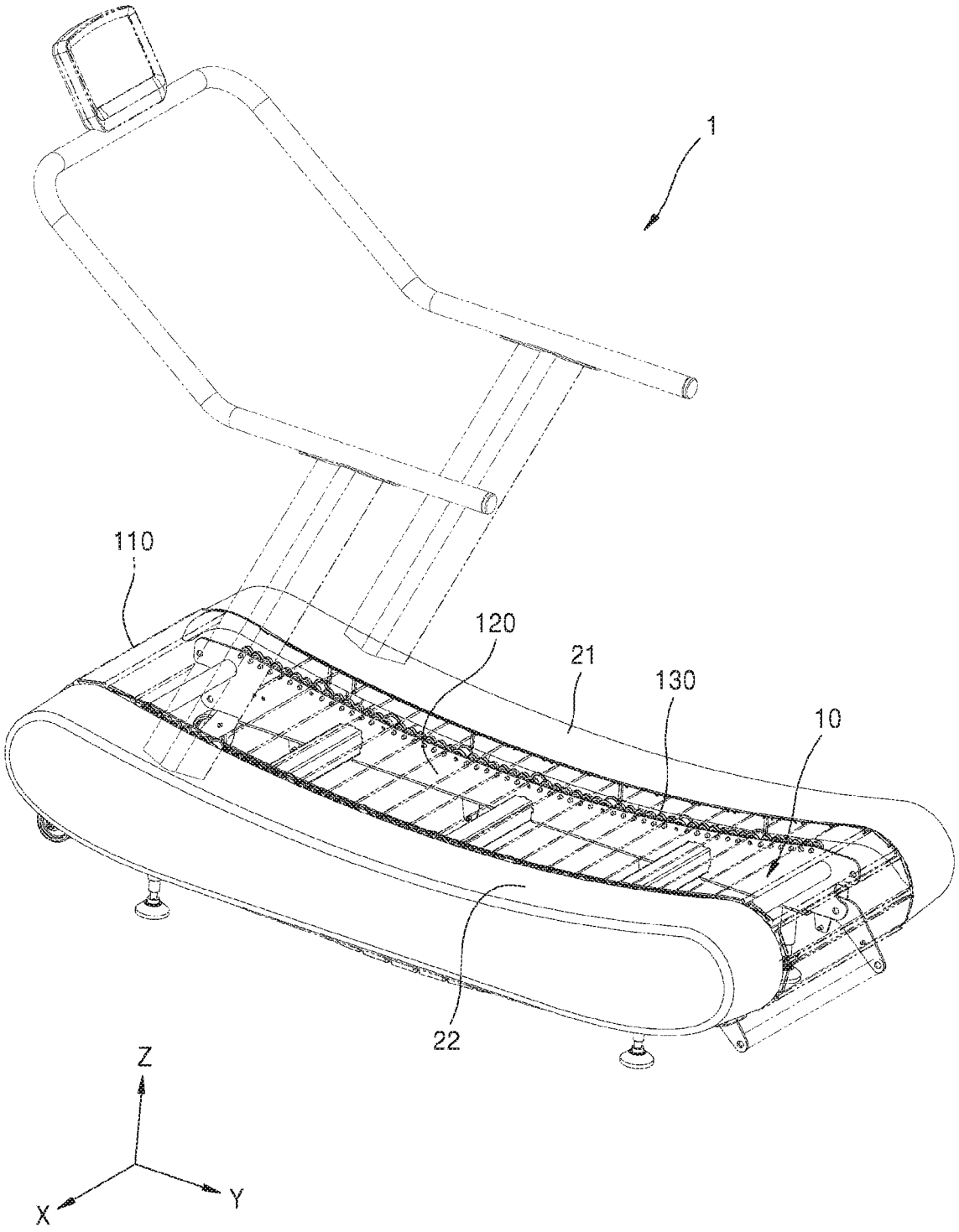
Figure 3A:
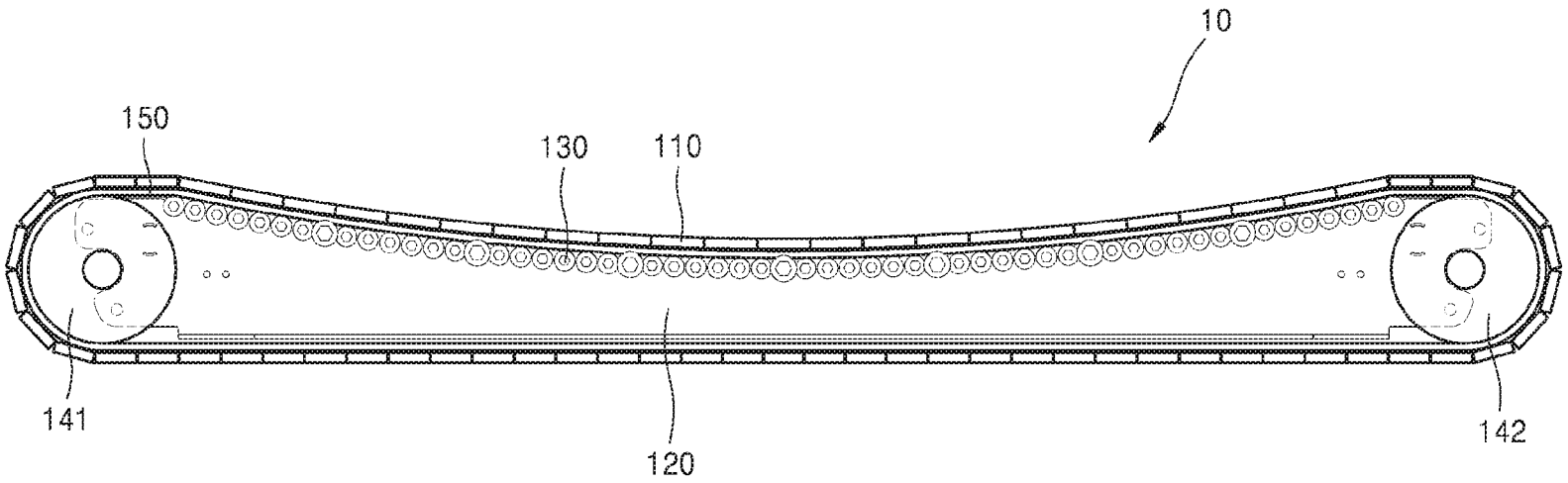
FIG. 3A is a side view of a motorless track shown in FIG. 1.
Figure 3B:
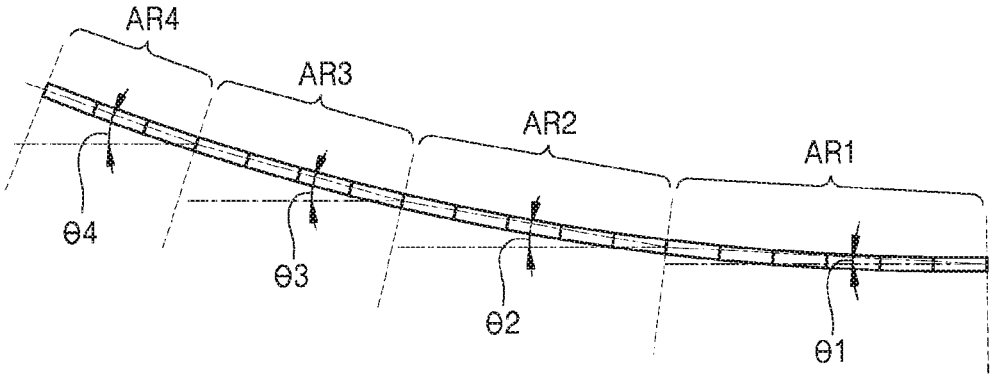
FIG. 3B is a conceptual view for describing the motorless track shown in FIG. 3A.

FIGS. 1 and 2 are perspective views of a motorless treadmill according to an embodiment of the present disclosure. FIG. 3A is a side view of a motorless track shown in FIG. 1, and FIG. 3B is a conceptual view for describing the motorless track shown in FIG. 3A.

Referring to FIGS. 1 and 2, a motorless treadmill 1 may include a motorless track 10, a pair of side covers 21 and 22, and a handle pole 50. The handle pole 50 may support a handle installed for safety when a user exercises.

The motorless track 10 may move when the user steps on the motorless track 10. The motorless track 10 may include a plurality of slats 110 and a support frame 120 which supports the plurality of slats 110 such that the plurality of slats 110 move.

Both ends of the plurality of slats 110 may be disposed on a belt 150 for connecting the plurality of slats 110. On the support frame 120, a plurality of rotating members 130, a front pulley 141, and a rear pulley 142 may be disposed to move the belt 150. The plurality of rotating members 130 may be ball bearings.

Each of the plurality of slats 110 may extend in a first direction, and the plurality of slats 110 may be arranged in a second direction that is perpendicular to the first direction. In FIGS. 1 and 2, the first direction may be an X-axis direction, and the second direction may be a Y-axis direction. When a user exercises on the motorless treadmill 1, the plurality of slats 110 may move in the second direction by an operation of the user's foot.

Referring to FIGS. 3A and 3B, the motorless track 10 may be inclined at a greater inclination angle with respect to the ground toward a front end and a rear end. For example, the motorless track 10 may have a curved shape in which the front and rear parts are higher than the middle part.

The motorless track 10 may have a plurality of inclination areas AR1, AR2, AR3, and AR4 inclined at greater inclination angles with respect to the ground toward the front end. For example, the motorless track 10 may include a first inclination area AR1 having a smallest inclination angle θ1, a second inclination area AR2 having an inclination angle θ2 that is greater than that of the first inclination area AR1, a third inclination area AR3 having an inclination angle θ3 that is greater than that of the second inclination area AR2, and a fourth inclination area AR4 having an inclination angle θ3 that is greater than that of the third inclination area AR3.

When the motorless track 10 has a curved shape, each of the inclination areas AR1, AR2, AR3, and AR4 may have a plurality of different inclination angles. In this case, that an inclination angle of each of the inclination areas AR1, AR2, AR3, and AR4 is great or small means that an average inclination angle of each of the inclination areas AR1, AR2, AR3, and AR4 is great or small.

The plurality of inclination areas AR1, AR2, AR3, and AR4 may have different lengths in a movement direction of the motorless track 10. For example, the length of the second inclination area AR2 may be less than that of the first inclination area AR1, the length of the third inclination area AR3 may be less than that of the second inclination area AR2, and the length of the fourth inclination area AR4 may be less than that of the third inclination area AR3.

The motorless track 10 may change a movement speed according to a location at which the user steps on the motorless track 10. Since the motorless track 10 has a curved shape, the inclination angle of the motorless track 10 at a location at which the user steps on the motorless track 10 may be greater as the location at which the user steps on the motorless track 10 is closer to a front end of the motorless track 10. At the greater inclination angle of the motorless track 10, a smaller normal force may be applied to the motorless track 10 even though the user steps on the motorless track 10 with the same force. The smaller normal force may reduce a friction force applied to the slats 110, so that the speed of the slats 110 of the motorless track 10 may increase. In other words, although the user steps on the motorless track 10 with the same force, the motorless track 10 may move at a higher speed as a location at which the user steps on the motorless track 10 is closer to the front end of the motorless track 10.

Referring again to FIG. 1, the pair of side covers 21 and 22 may be disposed at both ends in longitudinal direction (X-axis direction) of the slats 110. In the insides of the pair of side covers 21 and 22, first and second side frames (not shown) may be disposed.

The upper portions of the pair of side covers 21 and 22 may have a curved shape. Also, the pair of side covers 21 and 22 may be formed of a plastic material.

On the pair of side covers 21 and 22, a speed-related indicator 200 may be disposed to display information related to a movement speed of the motorless track 10. Through the speed-related indicator 200, the user may easily understand the property of the motorless track 10 that changes a speed according to a location at which the user steps on the motorless track 10, and may easily estimate his/her speed based on the property of the motorless track 10.

Figure 4:
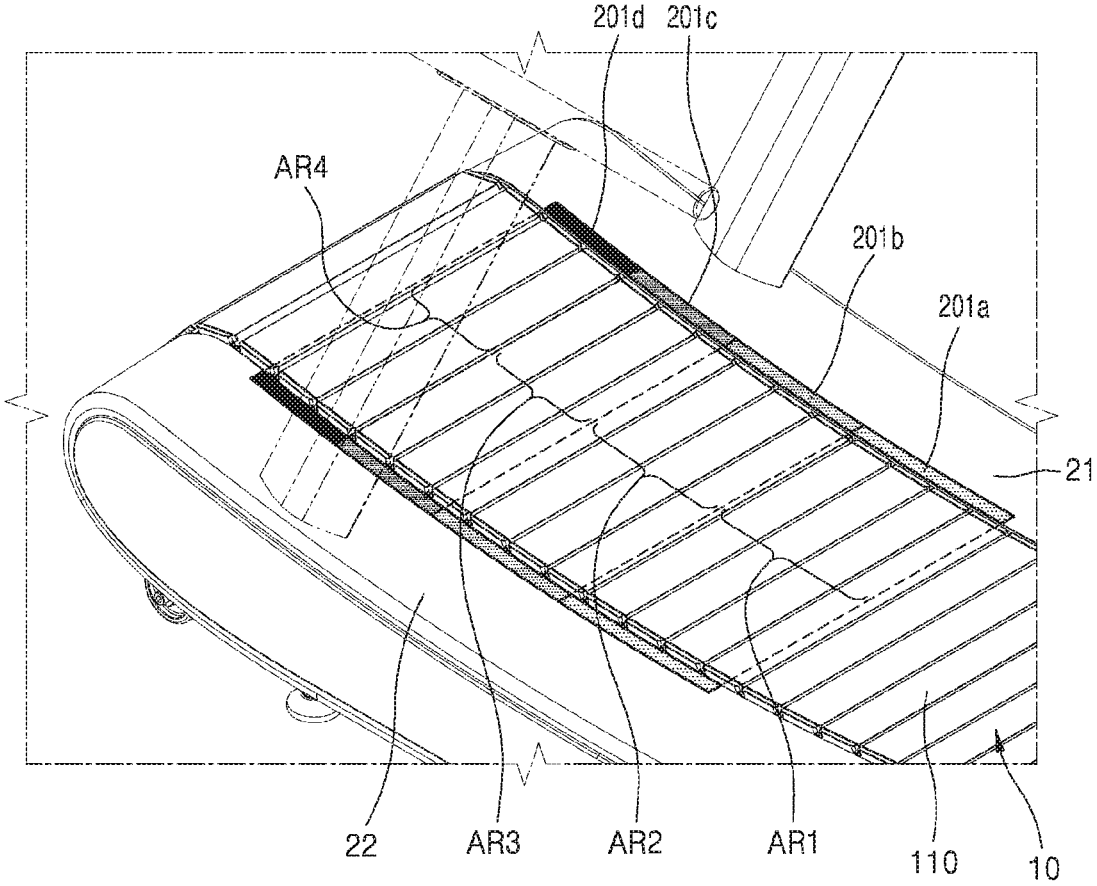
FIG. 4 is an enlarged perspective view of a part of FIG. 1.

FIG. 4 is an enlarged perspective view of a part of FIG. 1. Referring to FIGS. 1 and 4, the speed-related indicator 200 may include a plurality of speed areas 201*a*, 201*b*, 201*c*, and 201*d* extending in the movement direction of the motorless track 10.

Lengths of the plurality of speed areas 201*a*, 201*b*, 201*c*, and 201*d* may respectively correspond to the lengths of the inclination areas AR1, AR2, AR3, and AR4 of the motorless track 10, which are adjacent in the first direction (X-axis direction) to the respective speed areas 201*a*, 201*b*, 201*c*, and 201*d*.

The plurality of speed areas 201*a*, 201*b*, 201*c*, and 201*d* may have different lengths. The lengths of the plurality of speed areas 201*a*, 201*b*, 201*c*, and 201*d* may be shortened toward the front end. In the plurality of speed areas 201*a*, 201*b*, 201*c*, and 201*d*, the length of the first speed area 201*a* adjacent to the first inclination area AR1 may be longer than that of the fourth speed area 201*d* adjacent to the fourth inclination area AR1. For example, in the plurality of speed areas 201*a*, 201*b*, 201*c*, and 201*d*, the length of the first speed area 201*a* may be longer than that of the second speed area 201*b*, the length of the second speed area 201*b* may be longer than that of the third speed area 201*c*, and the length of the third speed area 201*c* may be longer than that of the fourth speed area 201*d*.

The plurality of speed areas 201*a*, 201*b*, 201*c*, and 201*d* may be indicated to distinguish from each other. For example, the plurality of speed areas 201*a*, 201*b*, 201*c*, and 201*d* may have different colors. For example, all of the plurality of speed areas 201*a*, 201*b*, 201*c*, and 201*d* may have different colors, or neighboring ones of the plurality of speed areas 201*a*, 201*b*, 201*c*, and 201*d* may have different colors. According to another example, the plurality of speed areas 201*a*, 201*b*, 201*c*, and 201*d* may have different shapes or forms, although not shown in the drawings.

The plurality of speed areas 201*a*, 201*b*, 201*c*, and 201*d* may be disposed on the side covers 21 and 22 in such a way to face the ends of the slats 110.

Through the speed-related indicator 200, the user may intuitively understand the property of the motorless track 10 of changing speed according to a location at which the user steps on the motorless track 10, and may easily estimate his/her speed based on the property of the motorless track 10.

As described above, the motorless track 10 may have the plurality of inclination areas AR1, AR2, AR3, and AR4 inclined at different inclination angles. When the user does not stand on the motorless treadmill 1, the user may easily recognize differences between the inclination angles. However, when the user stands on the motorless track 10, the user may be not easily recognize a change in inclination angle of the motorless track 10 since he/she looks at the motorless track 10 from above.

However, in the motorless treadmill 1 according to the current embodiment, the user may easily recognize a change in inclination angle of the motorless track 10 through the speed-related indicator 200 described above. Accordingly, the user may intuitively estimate his/her speed.

For example, the user may check the first speed area 201*a*, and step on the first inclination area AR1, thereby walking for exercise at a relatively low speed. Also, the user may check the second speed area 201*b*, and step on the second inclination area AR2 to increase the speed of the motorless track 10, thereby jogging for exercise. Also, the user may check the third speed area 201*c*, and step on the third inclination area AR3 to increase the speed of the motorless track 10, thereby running for exercise. Also, the user may check the fourth speed area 201*d*, and step on the fourth inclination area AR4 to further increase the speed of the motorless track 10, thereby fast running for exercise.

However, the speed-related indicator 200 is not limited to this, and the speed-related indicator 200 may be implemented in various ways as long as the speed-related indicator 20 informs the user of a speed. That is, the speed-related indicator 200 may have another form.

Figure 5:
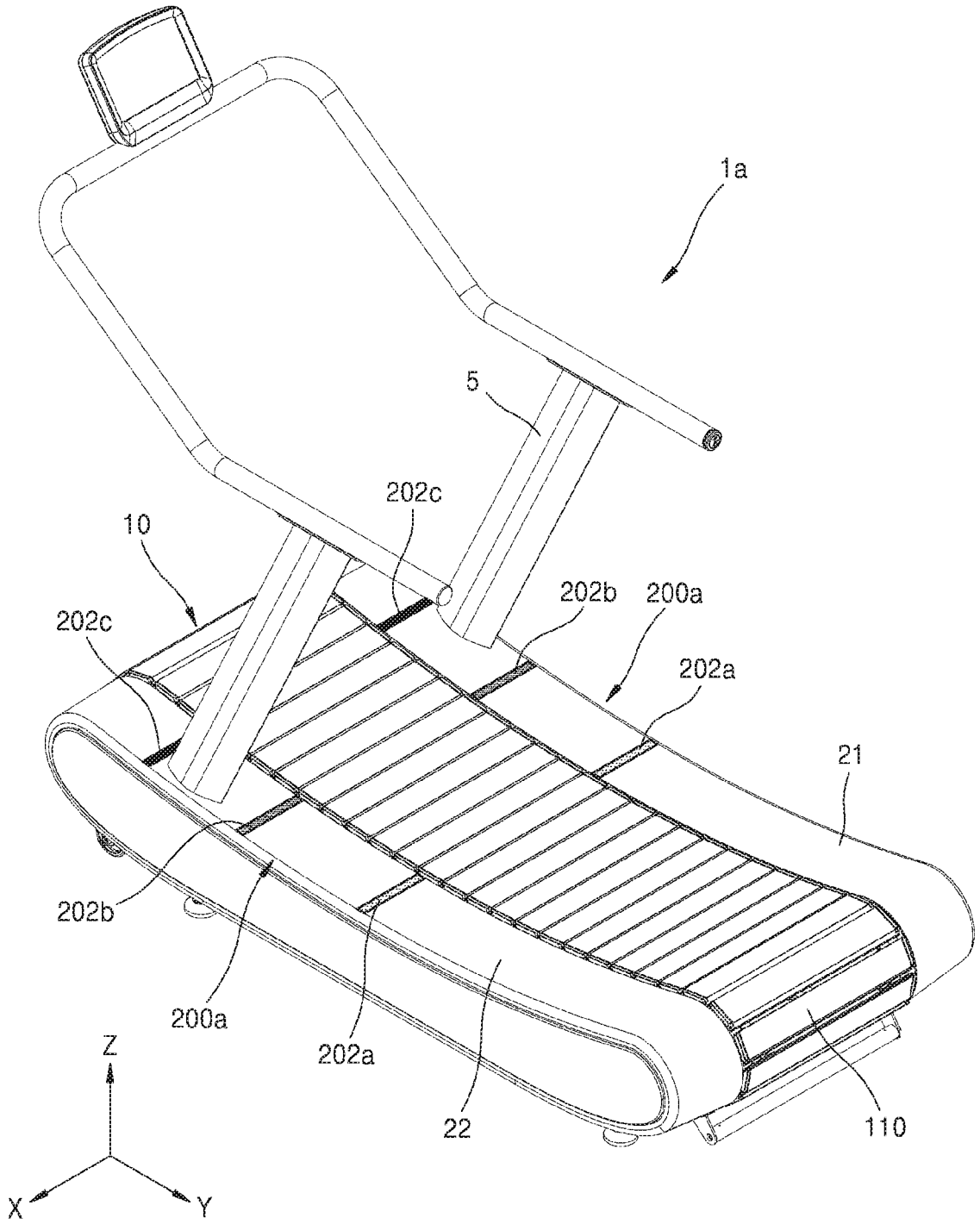
FIG. 5 is a perspective view of a motorless treadmill according to another embodiment of the present disclosure.

FIG. 5 is a perspective view of a motorless treadmill la according to another embodiment of the present disclosure. Referring to FIG. 5, a speed-related indicator 200*a* may include a plurality of lines 202*a*, 202*b*, and 202*c* extending in a direction crossing the movement direction (that is, the Y-axis direction) of the motorless track 10. The plurality of lines 202*a*, 202*b*, and 202*c* may be spaced from each other in the movement direction of the motorless track 10.

The plurality of lines 202*a*, 202*b*, and 202*c* may be indicated to be distinguish from each other. For example, the plurality of lines 202*a*, 202*b*, and 202*c* may have different colors. For example, all of the plurality of lines 202*a*, 202*b*, and 202*c* may have different colors, or neighboring ones of the plurality of lines 202*a*, 202*b*, and 202*c* may have different colors. According to another example, the plurality of lines 202*a*, 202*b*, and 202*c* may have different shapes or forms, although not shown in the drawings.

Figure 6A:
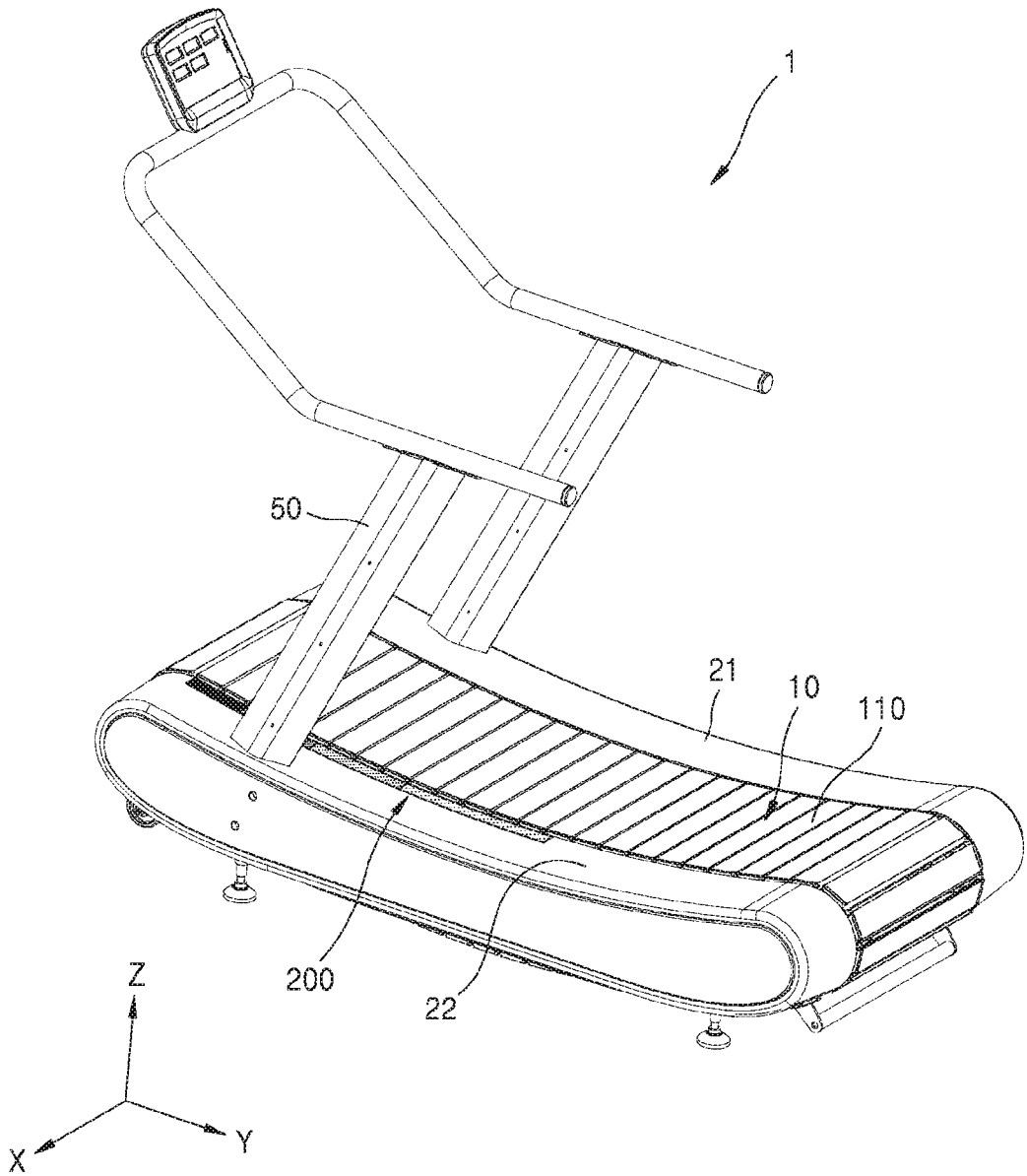
FIGS. 6A and 6B are perspective views of motorless treadmills according to other embodiments of the present disclosure.
Figure 6B:
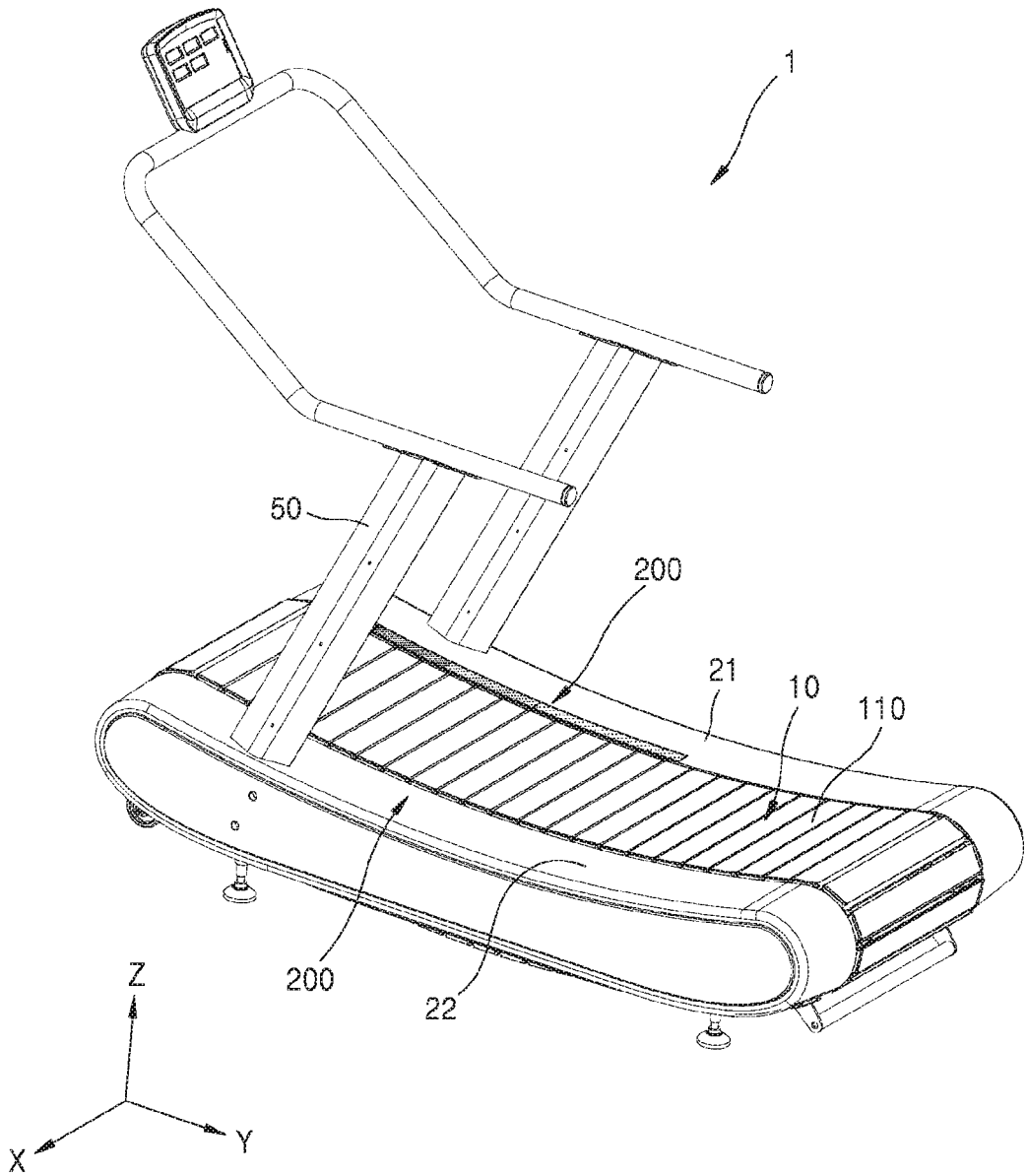

Meanwhile, the above-described embodiment relates to an example in which the speed-related indicator 200 is displayed on the pair of side covers 21 and 22. However, the present disclosure is not limited to the example. For example, as shown in FIGS. 6A and 6B, the speed-related indicator 200 may be disposed on any one of the pair of side covers 21 and 22.

The motorless treadmill according to an embodiment of the present disclosure may have the speed-related indicator for enabling a user to easily understand the property of the motorless track that changes a speed according to a location at which the user steps on the motorless track and to use the motorless track based on the property of the motorless track.

The embodiments of the present disclosure have been exemplarily described above, however, the scope of the present disclosure is not limited to the specific embodiments. That is, the present disclosure may be modified appropriately within the scope of the present disclosure written in the claims.

Other aspects, features, and advantages than those described above will be obvious from the following drawings and claims, and the detailed description. The general and detailed aspects can be embodied within system, method, computer program, or any combination thereof.

What is claimed is:

1. A motorless treadmill comprising:

a motorless track having a curved shape such that an inclination angle thereof increases with respect to the ground toward a front end and a rear end of the motorless track, and configured to move around a closed path by a user's footsteps; and a pair of side covers disposed on two opposing sides of the motorless track, wherein the motorless track changes a movement speed according to a location at which the user steps on the motorless track, and wherein, on at least one side cover of the pair of side covers, a speed-related indicator is disposed to indicate information related to the movement speed of the motorless track, wherein the speed-related indicator comprises a plurality of speed areas extending in a movement direction of the motorless track, and wherein neighboring speed areas of the plurality of speed areas have different colors to be respectively distinguished from each other.

2. The motorless treadmill of claim 1, wherein the motorless track comprises a plurality of inclination areas inclined at a greater inclination angle with respect to the ground surface toward the front end.

3. The motorless treadmill of claim 1, wherein the plurality of speed areas are disposed on the at least one side cover in such a way as to face the motorless track.

4. The motorless treadmill of claim 1, wherein the plurality of speed areas have respectively different lengths.

5. The motorless treadmill of claim 4, wherein the lengths of the plurality of speed areas decrease toward the front end.

6. The motorless treadmill of claim 1, wherein the motorless track comprises:

a plurality of slats extending in a direction that is perpendicular to the movement direction of the motorless track; and a support frame supporting the plurality of slats such that the plurality of slats move.

7. A motorless treadmill comprising:

a motorless track having a curved shape such that an inclination angle thereof increases with respect to the ground surface toward a front end and a rear end of the motorless track, and configured to move around a closed path by a user's footsteps; and a pair of side covers disposed on two opposing sides of the motorless track, wherein the motorless track changes a movement speed according to a location at which the user steps on the motorless track, and wherein, on at least one side cover of the pair of side covers, a speed-related indicator is disposed to indicate information related to the movement speed of the motorless track, wherein the speed-related indicator comprises a plurality of lines spaced from each other in a movement direction of the motorless track and the plurality of lines have respectively different colors.

* * * * *